US012492700B2

(12) United States Patent
Ukai et al.

(10) Patent No.: US 12,492,700 B2
(45) Date of Patent: Dec. 9, 2025

(54) COMPRESSOR ENDPLATE

(71) Applicant: FUJITSU GENERAL LIMITED, Kanagawa (JP)

(72) Inventors: Koji Ukai, Kanagawa (JP); Kenshi Ueda, Kanagawa (JP); Naoto Tada, Kanagawa (JP); Ryo Akimoto, Kanagawa (JP); Tatsuya Yasui, Kanagawa (JP); Yudai Morita, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 18/850,176

(22) PCT Filed: Feb. 22, 2023

(86) PCT No.: PCT/JP2023/006464
§ 371 (c)(1),
(2) Date: Sep. 24, 2024

(87) PCT Pub. No.: WO2023/189038
PCT Pub. Date: Oct. 5, 2023

(65) Prior Publication Data

US 2025/0207594 A1 Jun. 26, 2025

(30) Foreign Application Priority Data

Mar. 31, 2022 (JP) ..... 2022-058853

(51) Int. Cl.
*F04C 29/12* (2006.01)
*F04C 18/356* (2006.01)

(52) U.S. Cl.
CPC ..... *F04C 29/12* (2013.01); *F04C 18/3562* (2013.01); *F04C 2250/102* (2013.01)

(58) Field of Classification Search
CPC . F04C 29/12; F04C 18/3562; F04C 2250/102
(Continued)

(56) References Cited

U.S. PATENT DOCUMENTS

2018/0135632 A1* 5/2018 Izumi ..... F04C 29/12

FOREIGN PATENT DOCUMENTS

EP 4513038 A1 * 2/2025 ..... F04C 23/008
JP S59-096391 U 6/1984
(Continued)

OTHER PUBLICATIONS

Translation WO-2018088409-A1 (Year: 2025).*
Translation WO-2021079401-A1 (Year: 2025).*
Translation WO-2023189038-A1 (Year: 2025).*

*Primary Examiner* — J. Todd Newton
(74) *Attorney, Agent, or Firm* — Paratus Law Group, PLLC

(57) ABSTRACT

An end plate includes a plurality of connection portions coupling a center portion and an outer peripheral portion, and a plurality of through holes formed between the connection portions. The center portion includes a recess portion having a discharge hole, and a fixing hole through which a fixing member for fixing a reed valve to the end plate passes. In a fan-shaped region surrounded by a first half line starting from a center of a shaft hole and passing through a center of the discharge hole, a second half line starting from the center of the shaft hole and passing through a center of the fixing hole, and an outer peripheral surface, the through hole is formed to be continuous in a circumferential direction of the fan-shaped region, and both ends of the through hole in the circumferential direction of the fan-shaped region are located outside the fan-shaped region.

9 Claims, 6 Drawing Sheets

(58) Field of Classification Search
USPC ..... 418/15
See application file for complete search history.

(56) References Cited

FOREIGN PATENT DOCUMENTS

| | | | | | |
|---|---|---|---|---|---|
| JP | 2003-239883 | A | | 8/2003 | |
| JP | 2015-197045 | A | | 11/2015 | |
| JP | 2016-118142 | A | | 6/2016 | |
| WO | WO-2018088409 | A1 | * | 5/2018 | ..... F04C 18/356 |
| WO | WO-2021079401 | A1 | * | 4/2021 | ..... F04C 29/00 |
| WO | WO-2023189038 | A1 | * | 10/2023 | ..... F04C 18/356 |

* cited by examiner

EMBODIMENT

COMPARATIVE EXAMPLE

COMPRESSOR ENDPLATE

CROSS REFERENCE TO PRIOR APPLICATION

This application is a National Stage Patent Application of PCT International Patent Application No. PCT/JP2023/006464 (filed on Feb. 22, 2023) under 35 U.S.C. § 371, which claims priority to Japanese Patent Application No. 2022-058853 (filed on Mar. 31, 2022), which are all hereby incorporated by reference in their entirety.

FIELD

The present invention relates to a compressor.

BACKGROUND

As a compressor, there is known a compressor in which a compression section and a motor, which drives the compression section via a rotation shaft, are accommodated inside a main body container, and an outer periphery of the compression section is joined to an inner periphery of the main body container. The compression section of this type of compressor includes a cylinder that forms a compression chamber and an end plate that closes one end of the cylinder in an axial direction of the rotation shaft, and an outer periphery of the end plate is joined to an inner periphery of the main body container by welding. One end face of such an end plate is provided with a discharge hole for discharging a working fluid from the compression chamber and a recess portion provided with a reed valve for opening and closing the discharge hole. In addition, a sliding surface with which an end face of a piston rolling inside the compression chamber is in sliding contact, is formed on the other end face of the end plate.

CITATION LIST

Patent Literature

Patent Literature 1: JP 2016-118142 A

SUMMARY

Technical Problem

In the compressor described above, when the inner periphery of the main body container and the outer periphery of the end plate are joined by welding or shrink fitting, stress generated by welding or shrink fitting, is applied to the end plate, and the recess portion having low rigidity in the end plate, is deformed by the stress. In particular, in a case of a small compressor, since an inner diameter of the main body container becomes small and a distance between the outer periphery of the end plate and the recess portion becomes short, the stress is easily transmitted from the main body container to the recess portion, and deformation easily occurs in the recess portion. Such deformation of the recess portion causes distortion on the sliding surface of the end plate, which increases resistance at the time of sliding between the piston and the end plate.

The disclosed technology has been made in view of the above, and an object of the disclosed technology is to provide a compressor capable of preventing distortion from occurring on a sliding surface of an end plate due to stress caused by joining of a main body container and the end plate.

Solution to Problem

According to an aspect of an embodiments in the present application, a compressor includes: a compression section that compresses a working fluid; a motor that drives the compression section; a rotation shaft that transmits a driving force of the motor to the compression section; and a main body container that accommodates the compression section and the motor, wherein the compression section has a cylinder that forms a compression chamber of the working fluid, a piston that is disposed in the compression chamber, and an end plate that closes one end of the cylinder in an axial direction of the rotation shaft, the end plate has a shaft hole through which the rotation shaft passes, a center portion in which the shaft hole is provided and that forms a sliding surface on which the piston slides, an annular outer peripheral portion that is disposed on the outer peripheral side of the center portion and has an outer peripheral surface that is joined to an inner peripheral surface of the main body container, a plurality of connection portions that connect the center portion and the outer peripheral portion, and a plurality of through holes that are formed between the adjacent connection portions to penetrate the end plate, the center portion is provided with a recess portion having a discharge hole for discharging the working fluid from the compression section, and a fixing hole through which a fixing member for fixing a reed valve for opening and closing the discharge hole to the end plate passes, and in a fan-shaped region surrounded by a first half line starting from the center of the shaft hole and passing through the center of the discharge hole, a second half line starting from the center of the shaft hole and passing through the center of the fixing hole, and the outer peripheral surface of the outer peripheral portion, when the compressor is viewed in the axial direction of the rotation shaft, the through hole is formed to be continuous in the circumferential direction of the fan-shaped region, and both ends of the through hole in a circumferential direction of the fan-shaped region are located outside the fan-shaped region.

Advantageous Effects of Invention

According to one aspect of the compressor disclosed in the present application, it is possible to prevent distortion from occurring on the sliding surface of the end plate due to the stress caused by the joining between the main body container and the end plate.

DESCRIPTION OF EMBODIMENTS

Hereinafter, an embodiment of a compressor disclosed in the present application, will be described in detail with reference to the drawings. Note that the compressor disclosed in the present application is not limited by the following embodiment.

Embodiment

Figure 1:
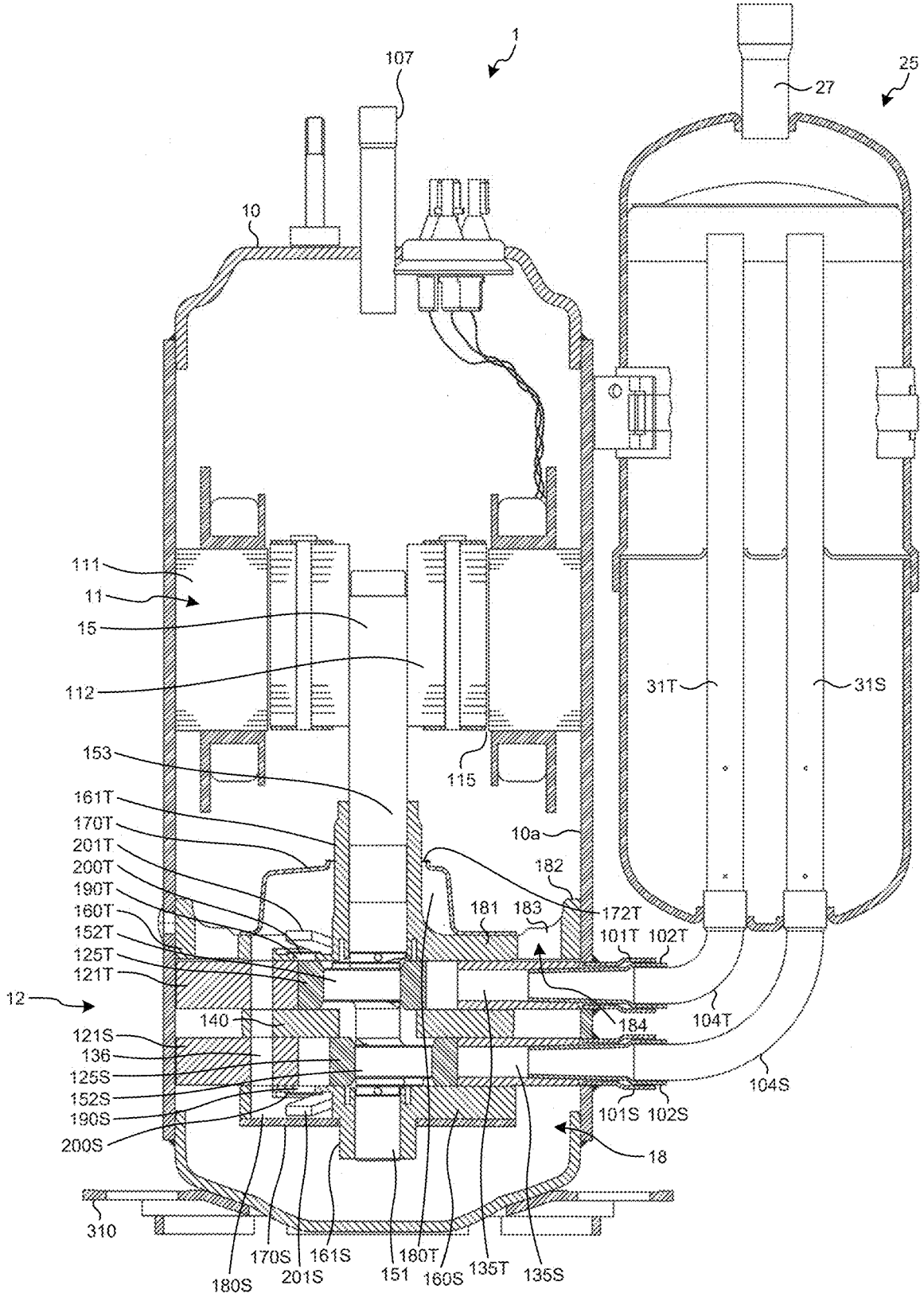
FIG. 1 is a longitudinal cross-sectional view illustrating a compressor according to an embodiment.

FIG. 1 is a longitudinal cross-sectional view illustrating a compressor according to the embodiment. As illustrated in FIG. 1, a compressor 1 is a hermetic compressor in which a compression section 12 that sucks a refrigerant as a working fluid from an accumulator 25 and discharges the compressed refrigerant into a main body container 10, and a motor 11, which drives the compression section 12, are accommodated in the main body container 10, and a high-pressure refrigerant, compressed by the compression section 12, is discharged into the main body container 10, and further discharged to a refrigeration cycle through a discharge pipe 107. The compressor 1 further includes a rotation shaft 15 that transmits a driving force of the motor 11 to the compression section 12, and the accumulator 25 that is fixed to an outer peripheral surface of the main body container 10.

In the main body container 10, an upper compression section suction pipe 102T and a lower compression section suction pipe 102S for sucking the low-pressure refrigerant of the refrigeration cycle into the compression section 12 are provided to penetrate the main body container 10. Specifically, an upper guide pipe 101T is fixed to the main body container 10 by brazing, and the upper compression section suction pipe 102T passes through the inside of the upper guide pipe 101T and is fixed to the upper guide pipe 101T by brazing. Similarly, a lower guide pipe 101S is fixed to the main body container 10 by brazing, and the lower compression section suction pipe 102S passes through the inside of the lower guide pipe 101S and is fixed to the lower guide pipe 101S by brazing.

A discharge pipe 107 for discharging the high-pressure refrigerant compressed by the compression section 12 from the inside of the main body container 10 to the refrigeration cycle, is provided to penetrate an upper portion of the main body container 10. A base member 310, which supports the entire compressor 1, is fixed to a lower portion of the main body container 10 by welding.

The accumulator 25 includes an accumulator suction pipe 27 for sucking the refrigerant from the refrigeration cycle into the accumulator 25, and an upper gas-liquid separation pipe 31T and a lower gas-liquid separation pipe 31S for sending a gas refrigerant to the compression section 12. The accumulator suction pipe 27 is connected to an upper portion of the accumulator 25. The upper gas-liquid separation pipe 31T is connected to the upper compression section suction pipe 102T via an upper communication pipe 104T. The lower gas-liquid separation pipe 31S is connected to the lower compression section suction pipe 102S via a lower communication pipe 104S.

Figure 2:
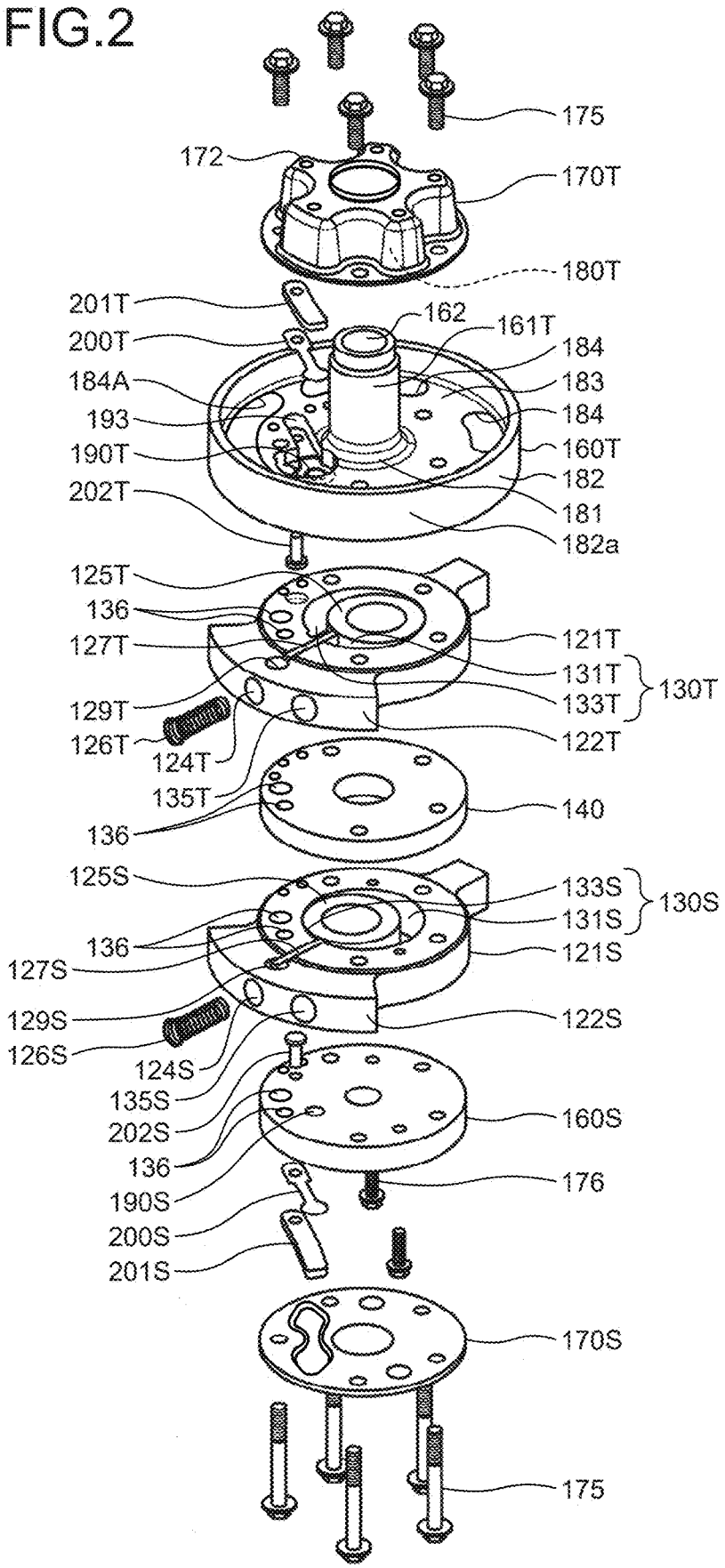
FIG. 2 is an exploded perspective view illustrating a compression section of the compressor according to the embodiment.

FIG. 2 is an exploded perspective view illustrating the compression section 12 of the compressor 1 according to the embodiment. As illustrated in FIGS. 1 and 2, the compression section 12 includes an upper cylinder 121T, a lower cylinder 121S, an intermediate partition plate 140, an upper end plate 160T, and a lower end plate 160S, and the upper end plate 160T, the upper cylinder 121T, the intermediate partition plate 140, the lower cylinder 121S, and the lower end plate 160S are stacked in this order and fixed by a plurality of bolts 175. The upper end plate 160T is provided with a main bearing portion 161T. The lower end plate 160S is provided with a sub bearing portion 161S. The rotation shaft 15 is provided with a main shaft portion 153, an upper eccentric portion 152T, a lower eccentric portion 152S, and a sub shaft portion 151. The rotation shaft 15 includes the main shaft portion 153 and the sub shaft portion 151 supported by the compression section 12. The main shaft portion 153 of the rotation shaft 15 is fitted into the main bearing portion 161T of the upper end plate 160T, and the sub shaft portion 151 of the rotation shaft 15 is fitted into the sub bearing portion 161S of the lower end plate 160S, whereby the rotation shaft 15 is rotatably supported by the main bearing portion 161T and the sub bearing portion 1613.

The motor 11 includes a stator 111 disposed outside, and a rotor 112 disposed inside. The stator 111 is fixed to an inner peripheral surface 10*a* of the main body container 10 by shrink fitting. The rotor 112 is fixed to the rotation shaft 15 by shrink fitting.

Inside the main body container 10, a lubricating oil 18 is sealed in an amount in which the compression section 12 is substantially immersed for lubricating a sliding member of the compression section 12 and sealing a high-pressure portion and a low-pressure portion in a compression chamber.

Next, the compression section 12 will be described in detail with reference to FIG. 2. A cylindrical upper hollow portion 130T is provided inside the upper cylinder 121T, and an upper piston 125T is disposed in the upper hollow portion 130T, The upper piston 125T is fitted into the upper eccentric portion 152T of the rotation shaft 15. A cylindrical lower hollow portion 130S is provided inside the lower cylinder 121S, and a lower piston 125S is disposed in the lower hollow portion 130S. The lower piston 125S is fitted into the lower eccentric portion 152S of the rotation shaft 15.

The upper cylinder 121T is provided with a groove portion, which extends from the upper hollow portion 130T to the outer peripheral side, and an upper vane 127T is disposed in the groove portion. The upper cylinder 121T is provided with an upper spring hole 124T, which communicates from the outer periphery to the groove portion, and an upper spring 126T is disposed in the upper spring hole 124T. The lower cylinder 121S is provided with a groove portion, which extends from the lower hollow portion 130S to the outer peripheral side, and a lower vane 127S is disposed in the groove portion. The lower cylinder 121S is provided with a lower spring hole 124S, which communicates from the outer periphery to the groove portion, and a lower spring 126S is disposed in the lower spring hole 124S.

One end of the upper vane 127T is pressed against the upper piston 125T by the upper spring 126T, so that a space outside the upper piston 125T in the upper hollow portion 130T of the upper cylinder 1211 is partitioned into an upper suction chamber 131T and an upper discharge chamber 133T which are upper compression chambers. The upper cylinder 121T is provided with an upper suction hole 135T, which communicates from the outer periphery to the upper suction chamber 1311. The upper compression section suction pipe 102T is connected to the upper suction hole 135T. One end of the lower vane 127S is pressed against the lower piston 125S by the lower spring 126S, so that a space outside the lower piston 125S in the lower hollow portion 130S of the lower cylinder 121S is partitioned into a lower suction chamber 131S and a lower discharge chamber 133S which are lower compression chambers. The lower cylinder 121S is provided with a lower suction hole 135S, which communicates from the outer periphery to the lower suction chamber 131S. The lower compression section suction pipe 102S is connected to the lower suction hole 135S.

The upper end plate 160T is provided with an upper discharge hole 190T, which penetrates the upper end plate 160T and communicates with the upper discharge chamber 133T. An upper discharge valve 200T, which is a reed valve for opening and closing the upper discharge hole 190T, and an upper discharge valve presser 201T for regulating warpage of the upper discharge valve 200T, are fixed to the upper end plate 160T by an upper rivet 202T. An upper end plate cover 170T, which covers the upper discharge hole 190T, is disposed above the upper end plate 160T, and an upper end plate cover chamber 180T, which is closed by the upper end plate 160T and the upper end plate cover 170T, is formed. The upper end plate cover 170T is fixed to the upper end plate 160T by the plurality of bolts 175 for fixing the upper end plate 160T and the upper cylinder 121T. The upper end plate cover 170T is provided with an upper end plate cover discharge hole 172, which communicates with the upper end plate cover chamber 180T and the inside of the main body container 10. When the compression section 12 is provided in the main body container 10, the inner peripheral surface 10*a* of the main body container 10 is shrink-fitted to an outer peripheral surface 182*a* of the upper end plate 160T, and is joined by a plurality of welding portions V (FIG. 4) welded to the main body container 10. Details of the structure of the upper end plate 160T in the present embodiment, will be described later.

The lower end plate 160S is provided with a lower discharge hole 190S, which penetrates the lower end plate 160S and communicates with the lower discharge chamber 133S. A lower discharge valve 200S, which is a reed valve for opening and closing the lower discharge hole 190S, and a lower discharge valve presser 201S for regulating warpage of the lower discharge valve 200S, are fixed to the lower end plate 160S by a lower rivet 202S. A lower end plate cover 170S, which covers the lower discharge hole 190S, is disposed below the lower end plate 160S, and a lower end plate cover chamber 180S, which is closed by the lower end plate 160S and the lower end plate cover 170S, is formed (see FIG. 1). The lower end plate cover 170S is fixed to the lower end plate 160S by the plurality of bolts 175, which fix the lower end plate 160S and the lower cylinder 121S.

The compression section 12 is provided with a refrigerant passage hole 136 (see FIG. 2), which penetrates the lower end plate 160S, the lower cylinder 121S, the intermediate partition plate 140, the upper end plate 160T, and the upper cylinder 121T and communicates with the lower end plate cover chamber 180S and the upper end plate cover chamber 180T.

A flow of the refrigerant by the rotation of the rotation shaft 15, will be described below. By the rotation of the rotation shaft 15, the upper piston 125T fitted into the upper eccentric portion 152T of the rotation shaft 15, and the lower piston 125S fitted into the lower eccentric portion 152S revolve, so that the upper suction chamber 131T and the lower suction chamber 131S suck the refrigerant while increasing the volume. As a refrigerant suction path, the low-pressure refrigerant of the refrigeration cycle is sucked into the accumulator 25 through the accumulator suction pipe 27, and only the gas refrigerant is sucked into the upper gas-liquid separation pipe 31T and the lower gas-liquid separation pipe 31S. The gas refrigerant, sucked into the upper gas-liquid separation pipe 31T, is sucked into the upper suction chamber 131T through the upper communication pipe 104T and the upper compression section suction pipe 102T. Similarly, the gas refrigerant, sucked into the lower gas-liquid separation pipe 31S, is sucked into the lower suction chamber 131S through the lower communication pipe 104S and the lower compression section suction pipe 102S.

Next, a flow of the discharge refrigerant by the rotation of the rotation shaft 15, will be described. By the rotation of the rotation shaft 15, the upper piston 125T, fitted into the upper eccentric portion 152T of the rotation shaft 15, revolves, so that the upper discharge chamber 133T compresses the refrigerant while reducing the volume. When the pressure of the compressed refrigerant becomes higher than the pressure of the upper end plate cover chamber 180T outside the upper discharge valve 200T, the upper discharge valve 200T is opened to discharges the refrigerant from the upper discharge chamber 133T to the upper end plate cover chamber 180T. The refrigerant, discharged into the upper end plate cover chamber 180T, is discharged into the main body container 10 from the upper end plate cover discharge hole 172, provided in the upper end plate cover 170T.

By the rotation of the rotation shaft 15, the lower piston 125S, fitted into the lower eccentric portion 152S of the rotation shaft 15, revolves, so that the lower discharge chamber 133S compresses the refrigerant while reducing the volume. When the pressure of the compressed refrigerant becomes higher than the pressure of the lower end plate cover chamber 180S outside the lower discharge valve 200S, the lower discharge valve 200S is opened to discharge the refrigerant from the lower discharge chamber 133S to the lower end plate cover chamber 180S. The refrigerant, discharged into the lower end plate cover chamber 180S, passes through the refrigerant passage hole 136 and the upper end plate cover chamber 180T, and is discharged into the main body container 10 from the upper end plate cover discharge hole 172T, provided in the upper end plate cover 170T.

The refrigerant, discharged into the main body container 10, is guided above the motor 11 through a notch (not illustrated) provided on the outer periphery of the stator 111 to communicate with the upper and lower sides, a gap (not illustrated) of a winding portion of the stator 111, or a gap 115 (see FIG. 1) between the stator 111 and the rotor 112, and is discharged from the discharge pipe 107, disposed in the upper portion of the main body container 10.

Next, a flow of the lubricating oil 18 will be described. The lubricating oil 18, sealed in the lower portion of the main body container 10, is supplied to the compression section 12 through the inside (not illustrated) of the rotation shaft 15 by a centrifugal force of the rotation shaft 15. The lubricating oil 18, supplied to the compression section 12, is caught in the refrigerant to form a mist, and is discharged into the main body container 10 together with the refrigerant. The lubricating oil 18, discharged into the main body container 10 in the form of the mist, is separated from the refrigerant by the centrifugal force by the rotational force of the motor 11, and returns to the lower portion of the main body container 10 as oil droplets again. However, a part of the lubricating oil 18 is not separated, and is discharged to the refrigeration cycle together with the refrigerant. The lubricating oil 18, discharged to the refrigeration cycle, circulates through the refrigeration cycle and returns to the accumulator 25, is separated inside the accumulator 25, and stays in the lower portion of the accumulator 25. The lubricating oil 18 staying in the lower portion of the accumulator 25, is sucked into the upper suction chamber 131T and the lower suction chamber 131S together with the suction refrigerant.

(Characteristic Configuration of Compressor)

Next, a characteristic configuration of the compressor 1 according to the embodiment, will be described. Characteristics of the embodiment include a structure of the upper end plate 160T joined to the main body container 10. Although the upper end plate 160T will be described below, the end plate in the disclosure of the present application is not limited to the upper end plate 160T. For example, in a case of a structure in which the outer peripheral portion of the lower end plate 160S is joined to the main body container 10, the present invention may be applied to the structure of the lower end plate 160S.

Figure 3:
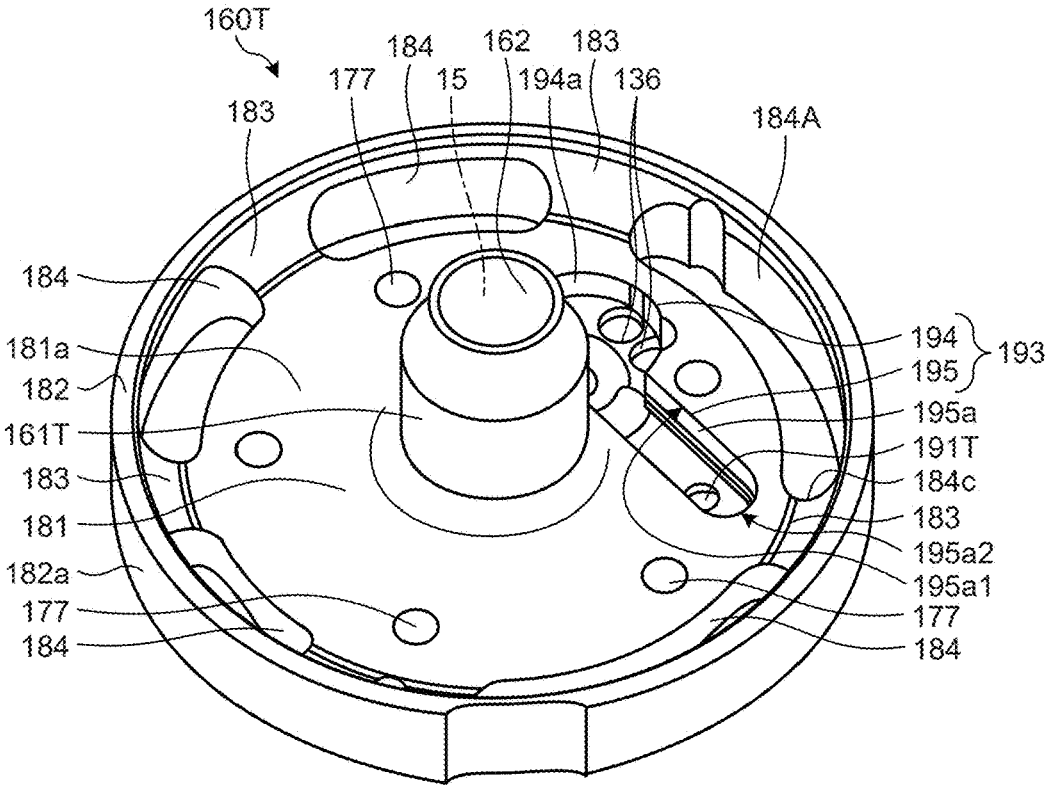
FIG. 3 is a perspective view illustrating an upper end plate of the compression section in the embodiment from above.
Figure 4:
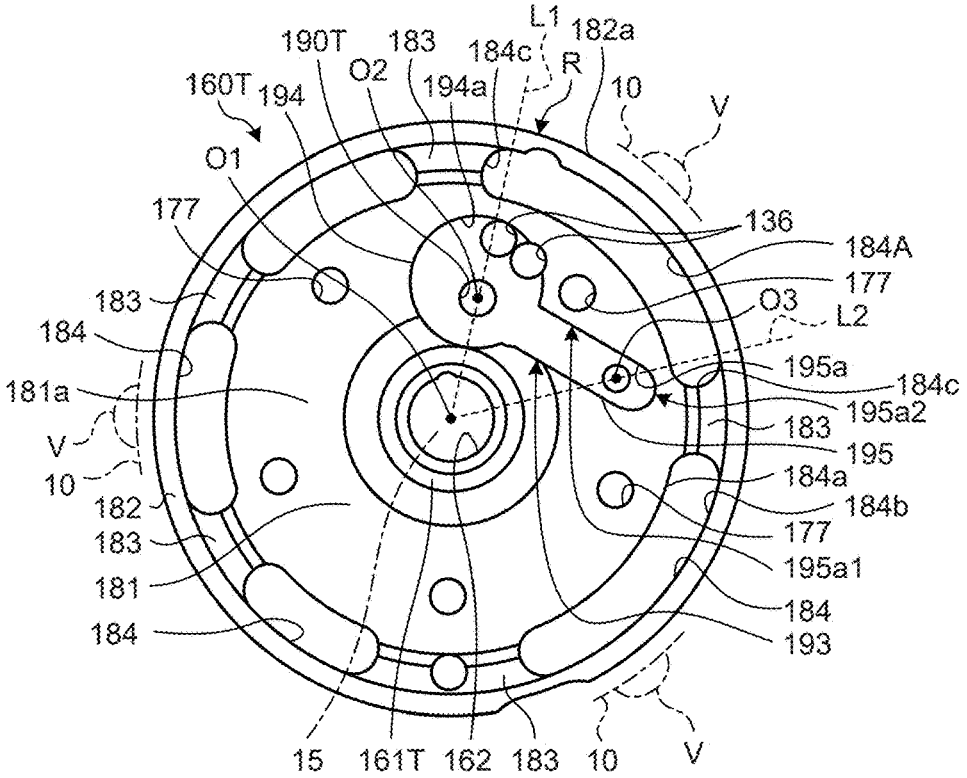
FIG. 4 is a plan view illustrating the upper end plate in the embodiment from above.

FIG. 3 is a perspective view illustrating the upper end plate 160T of the compression section 12 in the embodiment from above. FIG. 4 is a plan view illustrating the upper end plate 160T in the embodiment from above.

As illustrated in FIGS. 3 and 4, the upper end plate 160T has a circular center portion 181, in which a shaft hole 162 of the main bearing portion 161T is provided, an annular outer peripheral portion 182, which is disposed on the outer peripheral side of the center portion 181, a plurality of connection portions 183, which connects the outer peripheral side of the center portion 181 and the inner peripheral side of the outer peripheral portion 182, and a plurality of through holes 184, which is formed along a circumferential direction of the upper end plate 160T.

The main shaft portion 153 of the rotation shaft 15 rotatably passes through the shaft hole 162 of the main bearing portion 161T. The center portion 181 of the upper end plate 160T has an upper end face 181*a* as a first end face on the upper end plate cover 170T side, and a lower end face 181*b* as a second end face on the upper cylinder 121T side (see FIG. 6). A flat sliding surface 185, on which the upper end face of the upper piston 125T slides, is formed on the lower end face 181*b* of the center portion 181.

The main bearing portion 161T is formed in a protruding manner at the center of the upper end face 181*a* of the center portion 181. On the upper end face 181*a* of the center portion 181, bolt holes 177, through which the bolts 175 pass, are provided at intervals in the circumferential direction on the outer peripheral side of the main bearing portion 161T.

On the upper end face 181*a* of the center portion 181, a recess portion 193, which has an upper discharge hole 190T for discharging the refrigerant from the compression section 12 and an upper rivet hole 191T as a fixing hole for fixing the upper discharge valve 200T for opening and closing the upper discharge hole 190T to the upper end plate 160T, is formed. An upper rivet 202T as a fixing member passes through the upper rivet hole 191T, and a base end portion of the upper discharge valve 200T is fixed.

The recess portion 193 is formed by connecting a first recess portion 194, which is formed in a circular shape around the upper discharge hole 190T, and a second recess portion 195, which is formed linearly along a longitudinal direction of the upper discharge valve 200T. The first recess portion 194 has an inner wall surface 194*a* along the axial direction of the rotation shaft 15, and two refrigerant passage holes 136 are provided in the vicinity of the inner wall surface 194*a* on the outer peripheral portion 182 side. Similarly, the second recess portion 195 has an inner wall surface 195*a* along the axial direction of the rotation shaft 15, and is formed continuously with the inner wall surface 194*a* of the first recess portion 194.

The outer peripheral portion 182 of the upper end plate 160T has an outer peripheral surface 182*a*, which is joined to the inner peripheral surface 10*a* of the main body container 10. The outer peripheral portion 182 is formed such that the upper end of the outer peripheral portion 182 protrudes upward from the upper end face 181*a* of the center portion 181, and the lower end of the outer peripheral portion 182 has substantially the same height as the lower end face 181*b* of the center portion 181 (see FIG. 6).

Each connection portion 183 of the upper end plate 160T is integrally formed across the outer peripheral surface of the center portion 181, that is, an inner peripheral surface 184*a* on the radially inner side of the through hole 184, and the inner peripheral surface of the outer peripheral portion 182, that is, an outer peripheral surface 184*b* on the radially outer side of the through hole 184. Here, the radial direction of the through hole 184 refers to the radial direction of the upper end plate 160T.

The through hole 184 of the upper end plate 160T is formed in an elongated hole shape along the circumferential direction of the upper end plate 160T, between the connection portions 183 adjacent to each other in the circumferential direction of the upper end plate 160T. The through hole 184 functions as a flow path for returning the lubricating oil 18 flowing out from the main bearing portion 161T and the like of the upper end plate 160T to the lower portion of the main body container 10.

As illustrated in FIG. 4, when a half line, which passes through a center O2 of the upper discharge hole 190T with a center O1 of the shaft hole 162 as a starting point, is defined as a first half line L1, a half line, which passes through a center O3 of the upper rivet hole 191T with the center O1 of the shaft hole 162 as a starting point, is defined as a second half line L2, and a region, which is surrounded by the first half line L1, the second half line 12, and the outer peripheral surface 182*a* of the outer peripheral portion 182, is defined as a fan-shaped region R, as viewed from the axial direction of the rotation shaft 15 (hereinafter, referred to as an axial view), one through hole 184A of the plurality of through holes 184 is formed so as to be continuous over the fan-shaped region R in the circumferential direction of the fan-shaped region R (the circumferential direction of the shaft hole 162). Both ends 184*c* of the through hole 184A in the circumferential direction of the fan-shaped region R, are located outside the fan-shaped region R.

Since the through hole 184A is formed in the vicinity of the recess portion 193 as described above, the connection portion 183 is prevented from being disposed in the vicinity of the recess portion 193, so that it is possible to suppress deformation of the recess portion 193 due to transmission of stress at the time of joining by welding or shrink fitting between the upper end plate 160T and the main body container 10 through the connection portion 183. In particular, the center portion 181 of the upper end plate 160T in the present embodiment has a structure, in which the recess portion 193 is formed on the upper end face 181*a* and the sliding surface 185 is formed on the lower end face 181*b*. For this reason, when the recess portion 193 is deformed, the sliding surface 185 is likely to be distorted. However, the formation of the through hole 184A in the fan-shaped region R prevents distortion from occurring in the sliding surface 185 of the upper end plate 160T, and prevents an increase in resistance during sliding between the upper end face of the upper piston 125T and the sliding surface 185 of the upper end plate 160T.

In the axial view, the connection portion 183 is formed adjacent to the fan-shaped region R described above. As a result, the upper end plate 160T can appropriately secure the mechanical strength in the portion of the fan-shaped region R where the through hole 184A is continuously formed.

The plurality of welding portions V for joining the main body container 10 and the outer peripheral portion 182 of the upper end plate 160T, are provided on the outer peripheral surface of the main body container 10. As the welding portions V, for example, three welding portions V are provided at equal intervals in the circumferential direction of the main body container 10. Among the three welding portions V, one welding portion V is provided on the outer peripheral side of the through hole 184A, disposed in the fan-shaped region R described above. In other words, the welding portion V is provided at a position corresponding to the through hole 184A in the circumferential direction of the outer peripheral portion 182. As described above, even in a structure, in which stress is likely to be transmitted from the welding portion V to the recess portion 193 at the time of welding the upper end plate 160T and the main body container 10, both ends 184*c* of the through hole 184A are located outside the fan-shaped region R, so that the connection portion 183 is not disposed in the fan-shaped region R. Therefore, the stress is suppressed from being transmitted from the welding portion V to the recess portion 193 through the connection portion 183, and the occurrence of distortion of the sliding surface 185 can be suppressed.

In the present embodiment, stress, which is generated by joining the main body container 10 and the upper end plate 160T by shrink fitting (interference fitting), and stress, which is generated by joining the main body container 10 and the upper end plate 160T by the welding portion V, are applied to the upper end plate 160T. Although described later in detail with reference to FIG. 9, in the present embodiment, it is suppressed that these stresses are transmitted through the connection portion 183 to deform the recess portion 193. In the case of a structure in which the main body container 10 and the upper end plate 160T are joined by the welding portion V, a fitting state of the main body container 10 and the upper end plate 160T, is not limited to the interference fitting, and may be intermediate fitting or gap fitting. That is, regardless of the fitting state of the main body container 10 and the upper end plate 160T, an effect of suppressing the deformation of the recess portion 193 due to the stress from the welding portion V, can be obtained. In the structure in which the main body container 10 and the upper end plate 160T are welded to each other, the fitting state between the main body container 10 and the upper end plate 160T, may be the intermediate fitting or the gap fitting. In particular, in the case of the interference fitting, the effect of suppressing the deformation of the recess portion 193 due to the stress caused by the fitting, is high. Further, in the present embodiment, the case where the main body container 10 and the upper end plate 160T are joined by the shrink fitting and the welding portion V has been exemplified, but the main body container 10 and the upper end plate 160T may be joined only by the shrink fitting (interference fitting), and similarly, the main body container 10 and the upper end plate 160T may be joined only by the welding portion V. Even in these cases, it is possible to suppress the stress, which is generated by the joining between the main body container 10 and the upper end plate 160T, from being transmitted through the connection portion 183 to deform the recess portion 193.

A portion of the inner wall surface 194*a* of the first recess portion 194 continuous with the connection portion 183 in the radial direction of the shaft hole 162, is formed into a curved surface. Similarly, a portion of the inner wall surface 195*a* of the second recess portion 195 continuous with the connection portion 183 in the radial direction of the shaft hole 162, is formed into a curved surface. That is, a portion of the inner wall surface 195*a* of the second recess portion 195 on a fixing hole 191 side, is formed into a curved surface.

As described above, in each of the inner wall surfaces 194*a* and 195*a* of the recess portion 193, the portion continuous to each connection portion 183 adjacent to the through hole 184A, is formed into a curved surface, so that stress, which is transmitted from the connection portion 183 to the recess portion 193, is easily dispersed along the curved surfaces of the inner wall surfaces 194*a* and 195*a*, and the rigidity of the portion where the stress is easily transmitted, is increased. Therefore, in the present embodiment, as compared with the case where the stress is transmitted to the portion where the inner wall surfaces 194*a* and 195*a* are flat surfaces, the stress is transmitted to the portion where the inner wall surfaces are curved surfaces, so that the deformation of the recess portion 193 due to the stress is suppressed, and the occurrence of distortion in the sliding surface 185 is suppressed.

Figure 5:
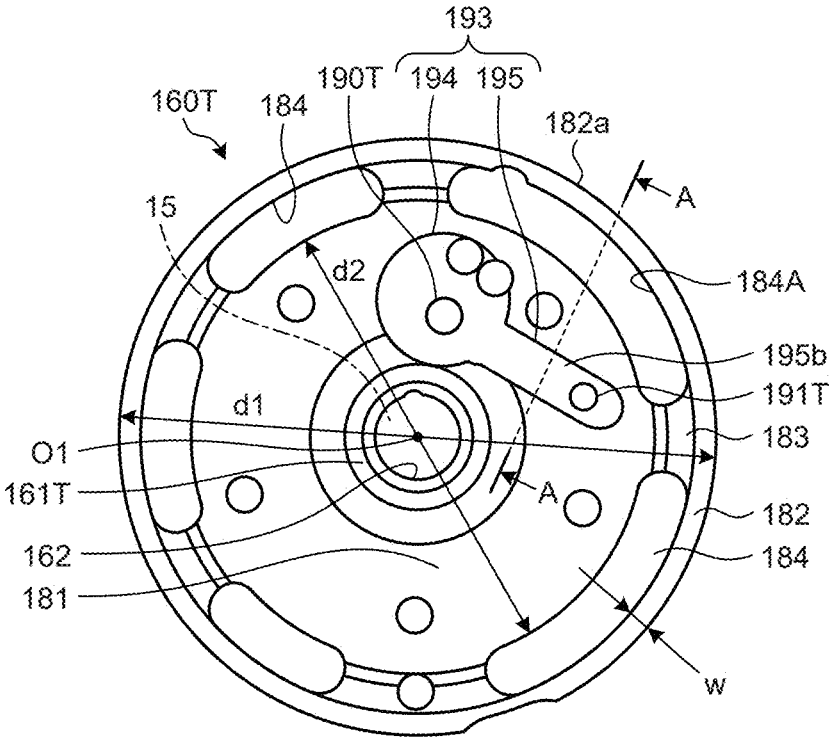
FIG. 5 is a plan view for explaining dimensions of each portion of the upper end plate in the embodiment.
Figure 6:
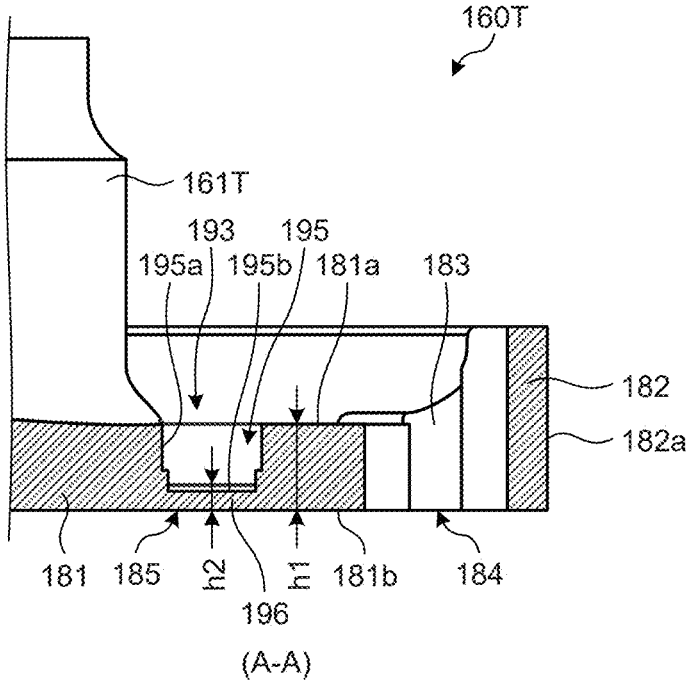
FIG. 6 is a cross-sectional view taken along the line A-A of the upper end plate in the embodiment.

FIG. 5 is a plan view for explaining dimensions of each portion of the upper end plate 160T in the embodiment. FIG. 6 is a cross-sectional view taken along the line A-A of the upper end plate 160T in the embodiment.

As illustrated in FIG. 6, when a thickness between the sliding surface 185 and the upper end face 181*a*, is h1, and a thickness of a bottom plate 196 between the sliding surface 185 and a bottom surface 195*b* in the recess portion 193, is h2, the center portion 181 of the upper end plate 160T satisfies $$(h2/h1) \leq 0.25(25[\%]) \quad \text{(Formula 1).}$$

As illustrated in FIG. 6, in the recess portion 193, a portion of the bottom plate 196 where the bottom surface 195*b* of the second recess portion 195 is formed, has the smallest thickness. The upper end plate 160T satisfies Formula 1, so that the difference between the thickness of the center portion 181 and the thickness of the bottom plate 196 of the recess portion 193 is large, and the rigidity of the recess portion 193 is low. For this reason, the recess portion 193 in the center portion 181 is easily deformed locally. In the case of such an upper end plate 160T, the effect of suppressing deformation of the recess portion 193 and occurrence of distortion of the sliding surface 185 by the through hole 184A, is high.

As illustrated in FIG. 5, when an outer diameter of the outer peripheral portion 182, is d1 and an outer diameter of the center portion 181, is d2, the upper end plate 160T satisfies $$(d2/d1) \geq 0.65(65[\%]) \quad \text{(Formula 2).}$$

The upper end plate 160T satisfies Formula 2, so that the outer periphery of the center portion 181 is close to the outer periphery of the outer peripheral portion 182, in other words, the width of the outer peripheral portion 182 with respect to the radial direction of the shaft hole 162 of the main bearing portion 161T, is small. In this case, the outer peripheral portion 182, which is joined to the main body container 10, and the center portion 181 come close to each other, and stress is easily transmitted from the main body container 10 to the recess portion 193 of the center portion 181, so that the recess portion 193 is easily deformed. In the case of such an upper end plate 160T, the effect of suppressing deformation of the recess portion 193 and occurrence of distortion of the sliding surface 185 by the through hole 184A, is high.

As illustrated in FIG. 5, when an outer diameter of the outer peripheral portion 182, is d1, and a width of the outer peripheral portion 182 in the radial direction of the shaft hole 162 of the main bearing portion 161T, is w1, the upper end plate 160T satisfies $$(w1/d1) \leq 0.05(5[\%]) \quad \text{(Formula 3).}$$

The upper end plate 160T satisfies Formula 3, so that the width w of the outer peripheral portion 182 with respect to the outer diameter d1 of the outer peripheral portion 182, is small, and the rigidity of the outer peripheral portion 182 is low. For this reason, the stress, which is transmitted from the main body container 10 to the center portion 181, tends to increase. In the case of such an upper end plate 160T, the effect of suppressing deformation of the recess portion 193 and occurrence of distortion of the sliding surface 185 by the through hole 184A, is high.

The outer diameter d1 of the outer peripheral portion 182 of the upper end plate 160T is 100 [mm] or less. In the case of using the upper end plate 160T in which the outer diameter d1 of the outer peripheral portion 182 is small as described above, the outer diameter of the main body container 10 is small, and the distance between the main body container 10 and the center portion 181 becomes short. Therefore, since stress is easily transmitted from the main body container 10 to the recess portion 193, the recess portion 193 is easily deformed. In the case of such an upper end plate 160T, the effect of suppressing deformation of the recess portion 193 and occurrence of distortion of the sliding surface 185 by the through hole 184A, is further high. Even in a case where the ratio (h2/h1) in Formula 1, described above, is the same, when the outer diameter d1 is 100 [mm] or less, the recess portion 193 is easily deformed as compared with when the outer diameter d1 is larger than 100 [mm], so that the above-described effect by the through hole 184A, is high.

Comparison Between Embodiment and Comparative Example

Figure 7:
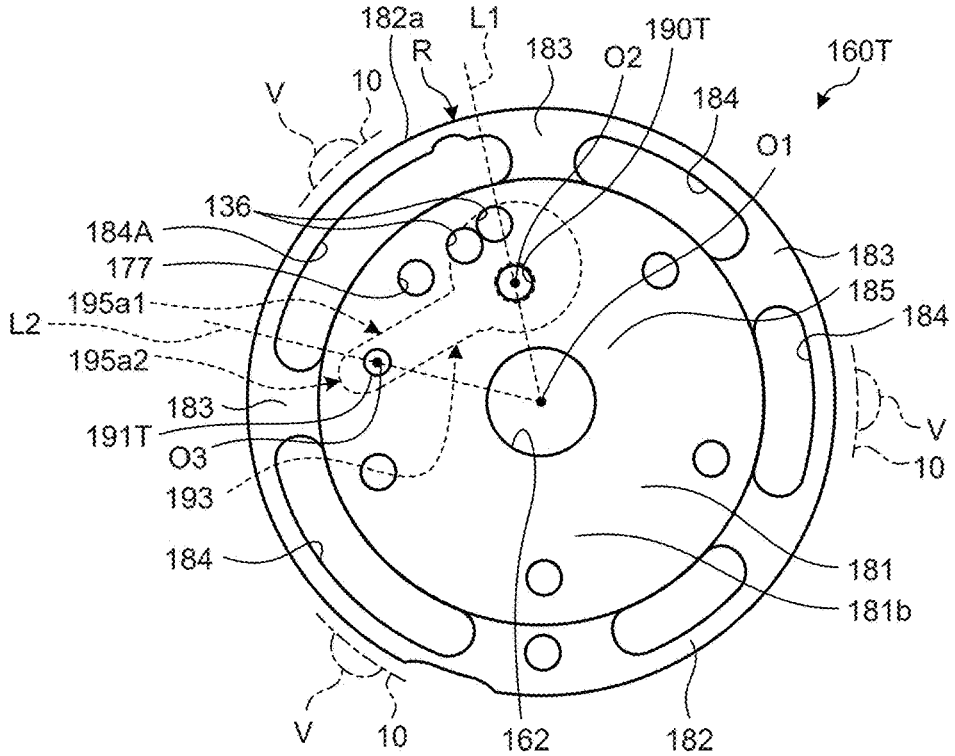
FIG. 7 is a plan view illustrating the upper end plate in the embodiment from below.
Figure 8:
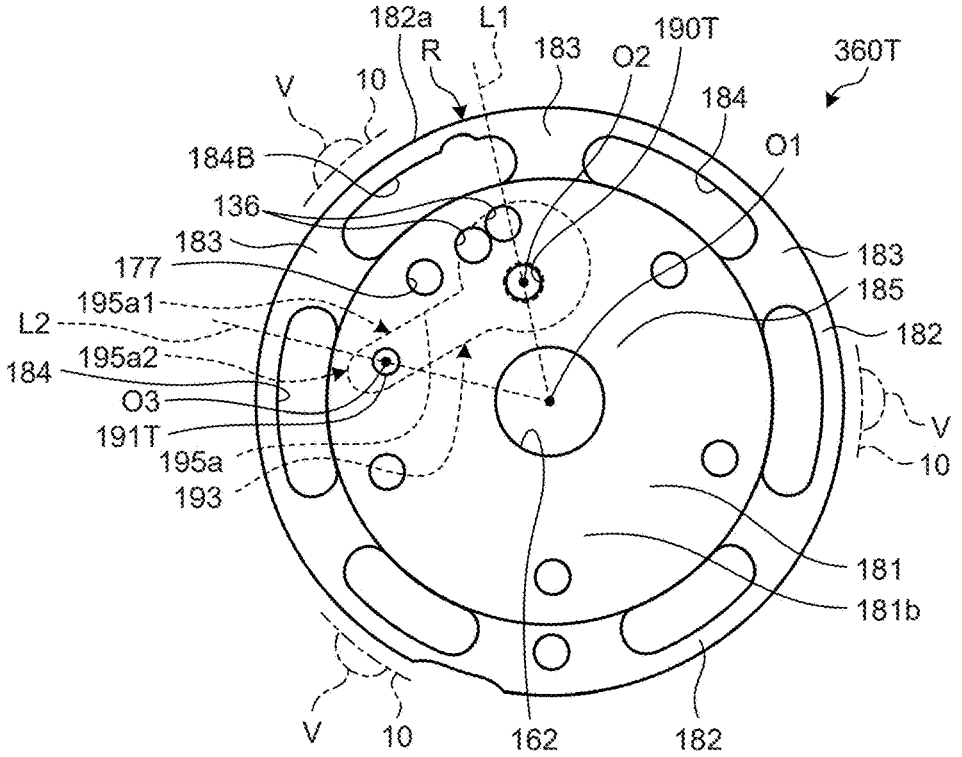
FIG. 8 is a plan view illustrating an upper end plate in a comparative example from below.

FIG. 7 is a plan view illustrating the upper end plate 160T in the embodiment from below. FIG. 8 is a plan view illustrating an upper end plate 360T in a comparative example from below. In the comparative example, the same portions as those of the upper end plate 160T in the embodiment are denoted by the same reference numerals as those in the embodiment, and description thereof is omitted.

As illustrated in FIGS. 7 and 8, in the upper end plate 360T in the comparative example, a through hole 184B formed in the vicinity of the recess portion 193 has a shorter length extending in the circumferential direction of the fan-shaped region R than the through hole 184A of the upper end plate 160T in the embodiment, and the connection portion 183 is disposed in the fan-shaped region R described above. In the embodiment and the comparative example, the structure of the center portion 181 or the outer peripheral portion 182 in which the recess portion 193 is formed and the structure of the main body container 10, are the same except for the arrangement of the through hole 184 and the connection portion 183.

(Deformation Amount Distribution)

Figure 9:
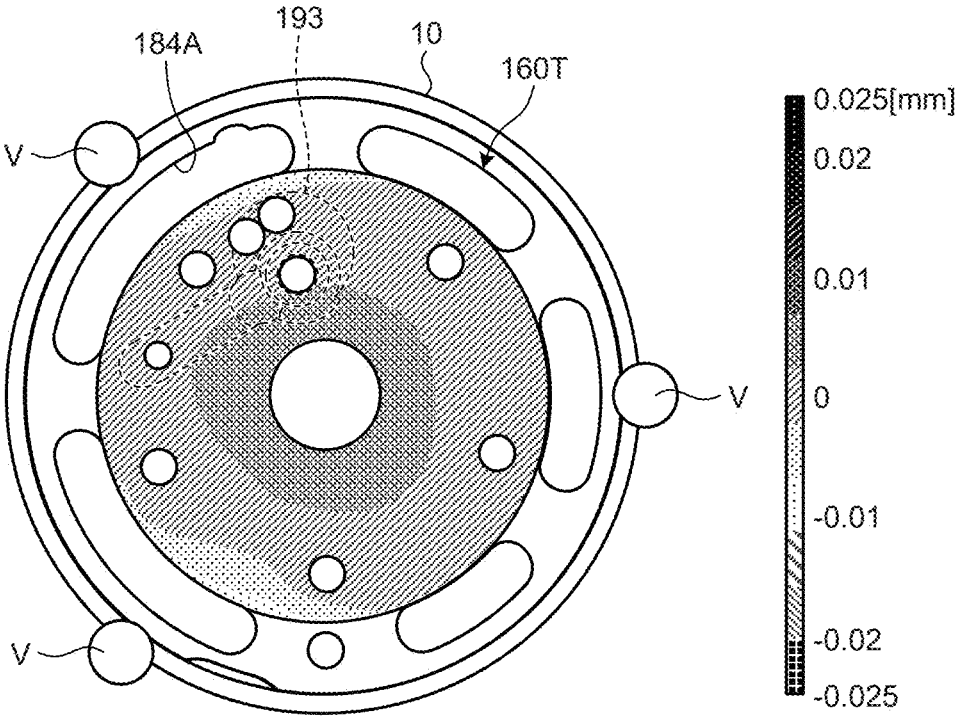
FIG. 9 is a view schematically illustrating a distribution of a deformation amount in an axial direction generated in the upper end plate in the embodiment.
Figure 10:
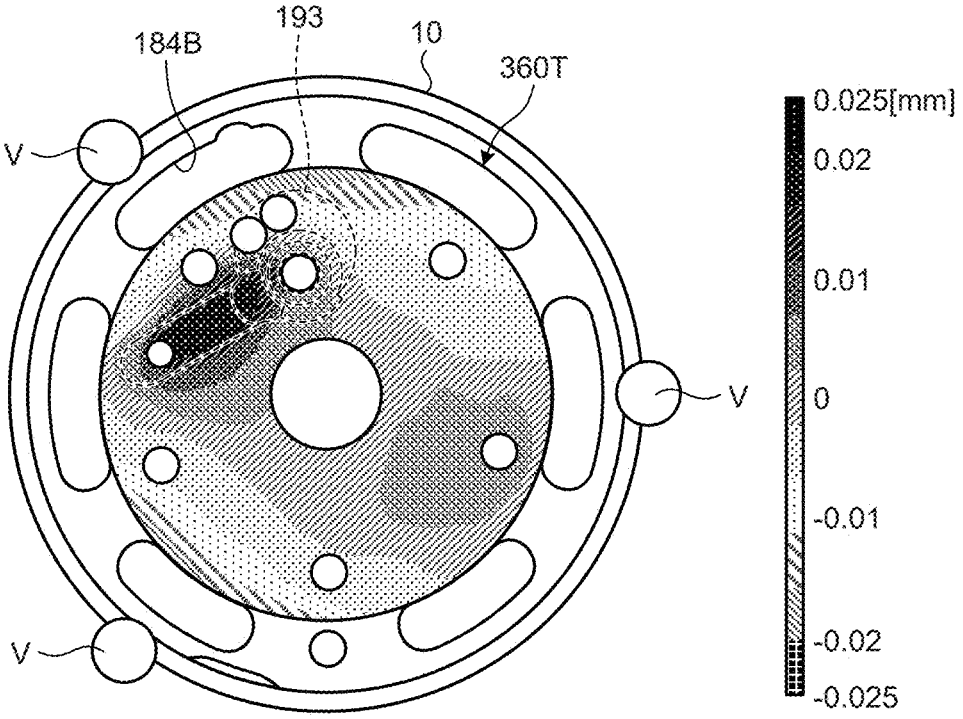
FIG. 10 is a view schematically illustrating a distribution of a deformation amount in the axial direction generated in the upper end plate in the comparative example.

FIG. 9 is a view schematically illustrating a distribution of a deformation amount in the axial direction of the rotation shaft 15 generated in the upper end plate 160T in the embodiment illustrated in FIG. 7 and the like. FIG. 10 is a view schematically illustrating a distribution of a deformation amount in the axial direction of the rotation shaft 15 generated in the upper end plate 360T in the comparative example illustrated in FIG. 8. That is, in the embodiment and the comparative example, the magnitude of the deformation amount in the axial direction at each position of the center portion 181 of the upper end plate 360T is illustrated in accordance with a legend in FIGS. 9 and 10. The distribution of the deformation amount in the axial direction of the rotation shaft 15 illustrated in FIGS. 9 and 10, is based on actual measurement data. FIGS. 9 and 10 illustrate the distribution of the deformation amount when the main body container 10 is shrink-fitted to the upper end plates 160T and 360T, and welded.

As illustrated in FIGS. 8 and 10, in the comparative example, one end portion of the through hole 184B in the circumferential direction of the fan-shaped region R, is formed to be located inside the fan-shaped region R, so that deformation of the rotation shaft 15 in the axial direction is large around the recess portion 193 in the center portion 181 and at a position corresponding to the recess portion 193 in the sliding surface 185. On the other hand, as illustrated in FIGS. 7 and 9, in the embodiment, the through hole 184A is formed so as to be continuous in the circumferential direction of the fan-shaped region R, and both ends 184*c* and 184*c* of the through hole 184A in the circumferential direction of the fan-shaped region R, are formed so as to be located outside the fan-shaped region R, so that deformation around the recess portion 193 in the center portion 181 and at a position corresponding to the recess portion 193 in the sliding surface 185, is reduced as compared with the comparative example. In the embodiment, in particular, the deformation of the second recess portion 195 of the recess portion 193 and the occurrence of distortion of the sliding surface 185, can be effectively suppressed. As a result, in the embodiment, the occurrence of deformation and distortion of the center portion 181 and the entire sliding surface 185, is suppressed as compared with the comparative example.

Here, in the embodiment, as illustrated in FIGS. 7 to 10, the deformation of the recess portion 193 and the occurrence of distortion of the sliding surface 185, are effectively suppressed as compared with the comparative example, and the reason for this will be described below.

First, a structure common to the embodiment and the comparative example will be described in detail. In the upper discharge valve 200T disposed in the recess portion 193 of the upper end plate 160T, one end side in the longitudinal direction (upper rivet hole 191T side) is fixed to the upper end plate 160T by the upper rivet 202T, and the other end side in the longitudinal direction (upper discharge hole 190T side) covers the upper discharge hole 190T, thereby opening and closing the upper discharge hole 190T. The recess portion 193, which is formed in the upper end plate 160T, needs to be formed in a size sufficient for disposing the upper discharge valve 200T described above, but if the recess portion 193, which is formed in the upper end plate 160T, is made too large, there is a problem that the mechanical strength of the upper end plate 160T is reduced. In order to regulate the upper discharge valve 200T from moving inside the recess portion 193, a part of the inner wall surface 194*a* of the recess portion 193 is formed along the outer shape of the upper discharge valve 200T. Due to these restrictions, the shape of the recess portion 193 formed in the upper end plate 160T is substantially a shape along the outer peripheral shape of the upper discharge valve 200T. Therefore, the fixing hole 191 is disposed near the end portion on one side in the longitudinal direction of the recess portion 193, and the upper discharge hole 190T is disposed near the end portion on the other side in the longitudinal direction of the recess portion 193.

As illustrated in FIGS. 2 to 8, as a structure common to the embodiment and the comparative example, the recess portion 193 of the upper end plate 160T is provided with the upper discharge hole 190T for discharging the refrigerant from the compression section 12, and the upper rivet hole 191T as a fixing hole for fixing the upper discharge valve 200T for opening and closing the upper discharge hole 190T to the upper end plate 160T. The recess portion 193 is formed by connecting the first recess portion 194, which is formed in a circular shape around the upper discharge hole 190T, and the second recess portion 195, which is formed linearly along the longitudinal direction of the upper discharge valve 200T. The first recess portion 194 has the inner wall surface 194*a* along the axial direction of the rotation shaft 15. The second recess portion 195 has the inner wall surface 195*a* along the axial direction of the rotation shaft 15, and is formed continuously with the inner wall surface 194*a* of the first recess portion 194. The inner wall surface 195*a* of the second recess portion 195 has a flat surface portion 195*a*1 that is linear in the axial view, and a curved surface portion 195*a*2 that is arcuate in the axial view. The upper rivet hole 191T is disposed in the second recess portion 195 near the boundary between the flat surface portion 195*a*1 and the curved surface portion 195*a*2 of the inner wall surface 195*a*.

In the embodiment, the upper discharge hole 190T is disposed near the center of the first recess portion 194, which is formed in a circular shape. That is, the upper discharge hole 190T is disposed in the first recess portion 194 having the inner wall surface 194*a* formed entirely in a curved surface. Therefore, of the two connection portions 183 and 183 adjacent to the through hole 184A, one connection portion 183 (near the first half line 11) faces the inner wall surface 194*a*, which is formed on the curved surface of the first recess portion 194. That is, a portion of the inner wall surface 194*a* of the first recess portion 194 continuous with the connection portion 183 in the radial direction of the shaft hole 162, is formed into a curved surface.

Also in the comparative example, of the two connection portions 183 and 183 adjacent to the through hole 184B, one connection portion 183 (near the first half line 11) faces the inner wall surface 194*a*, which is formed on the curved surface of the first recess portion 194. That is, the embodiment and the comparative example are common in that a portion of the inner wall surface 194*a* of the first recess portion 194 continuous with the connection portion 183 in the radial direction of the shaft hole 162, is formed into a curved surface.

Next, characteristic points in the difference between the embodiment and the comparative example will be described. As described above, in the upper end plate 360T in the comparative example, the through hole 184B, which is formed in the vicinity of the recess portion 193, has a shorter length extending in the circumferential direction of the fan-shaped region R than the through hole 184A of the upper end plate 160T in the embodiment. In other words, the through hole 184A in the embodiment has a longer length extending in the circumferential direction of the fan-shaped region R than the through hole 184B in the comparative example. More specifically, the through hole 184A of the embodiment is formed such that both ends 184*c* and 184*c* of the through hole 184A in the circumferential direction of the fan-shaped region R, are located outside the fan-shaped region R. On the other hand, the through hole 184B of the comparative example is different in that one end portion (end portion on the second half line L2 side) of the through hole 184B in the circumferential direction of the fan-shaped region R, is located inside the fan-shaped region R.

In the embodiment, as illustrated in FIG. 7 and the like, the other connection portion 183 (near the second half line L2) of the two connection portions 183 and 183 adjacent to the through hole 184A, faces the curved surface portion 195*a*2 of the inner wall surface 195*a* of the second recess portion 195 in the recess portion 193. Therefore, in the upper end plate 160T of the embodiment, a portion of the inner wall surface 195*a* of the second recess portion 195 continuous with the connection portion 183 in the radial direction of the shaft hole 162, is formed into a curved surface (arcuate shape in the axial view).

In the embodiment, since the portion continuous with the connection portion 183 in the radial direction of the shaft hole 162 is formed into the curved surface (arcuate shape in the axial view), the stress transmitted from the connection portion 183 in the vicinity of the second half line 12, is applied to the curved surface portion 195*a*2 facing the connection portion 183 in the inner wall surface 195*a* of the second recess portion 195. At this time, although the curved surface portion 195*a*2, which is located on the outer peripheral side in the inner wall surface 195*a* of the recess portion 193 illustrated in FIGS. 3, 6, 7, and the like, receives stress, the stress, transmitted from the connection portion 183, can be dispersed in the circumferential direction along the curved surface. As a result, in the embodiment, as illustrated in FIG. 9, deformation of the recess portion 193 and distortion of the sliding surface 185 are suppressed.

On the other hand, in the comparative example, as illustrated in FIG. 8 and the like, the other connection portion 183 (near the second half line 12) of the two connection portions 183 and 183 adjacent to the through hole 184B, faces the flat surface portion 195*a*1 of the inner wall surface 195*a* of the second recess portion 195 in the recess portion 193. Therefore, in the upper end plate 360T of the comparative example, a portion of the inner wall surface 195*a* of the second recess portion 195 continuous with the connection portion 183 in the radial direction of the shaft hole 162, is formed into a flat surface (linear shape in the axial view).

In the comparative example, since the portion continuous with the connection portion 183 in the radial direction of the shaft hole 162 is formed into a flat surface (linear shape in the axial view), the stress, transmitted from the connection portion 183 in the vicinity of the second half line 12, is applied to the flat surface portion 195*a*1, facing the connection portion 183 in the inner wall surface 195*a* of the second recess portion 195 illustrated in FIGS. 3, 6, 8, and the like. Therefore, the flat surface portion 195*a*1, which is located on the outer peripheral side in the inner wall surface 195*a* of the recess portion 193, receives stress and falls down to the inside of the recess portion 193, so that the bottom plate 196 of the recess portion 193 having a thin plate thickness connected to the flat surface portion 195*a*1 of the inner wall surface 195*a* rises by receiving a force in the axial direction of the rotation shaft 15 as the flat surface portion 195*a*1 falls down. As a result, in the comparative example, as illustrated in FIG. 10, deformation of the recess portion 193 and distortion of the sliding surface 185 occur.

As described above, in the comparative example, since the connection portion 183 is disposed at a position continuous with the flat inner wall surface 195*a* in the recess portion 193, deformation of the recess portion 193 and distortion of the sliding surface 185 are likely to occur. On the other hand, in the embodiment, since the inner wall surface 195*a* of the recess portion 193 at the position continuous with the connection portion 183 is a curved surface, the stress transmitted from the connection portion 183 can be dispersed in the circumferential direction along the curved surface, and the deformation of the recess portion 193 and the distortion of the sliding surface 185 can be suppressed from occurring.

In the embodiment, the upper discharge hole 190T, through which the first half line L1 passes, is disposed near the end portion on one side in the longitudinal direction of the recess portion 193, and the fixing hole 191, through which the second half line L2 passes, is disposed near the end portion on the other side in the longitudinal direction of the recess portion 193. Therefore, the flat surface portion 195*a*1 of the inner wall surface 195*a* of the recess portion 193 is disposed inside the fan-shaped region R. Therefore, by forming the through hole 184A such that both ends 184*c* and 184*c* of the through hole 184A in the circumferential direction of the fan-shaped region R, are located outside the fan-shaped region R, it is possible to realize a structure, in which the connection portion 183 is not disposed in the fan-shaped region R where the flat surface portion 195*a*1 of the inner wall surface 195*a* of the recess portion 193 is disposed. In other words, it is possible to realize a structure, in which the inner wall surface 195*a* of the recess portion 193 at the position facing the connection portion 183 is a curved surface.

Effects of Embodiment

As described above, the upper end plate 160T in the compressor 1 of the embodiment includes the center portion 181, in which the recess portion 193 is formed, and the plurality of through holes 184, which is formed between the adjacent connection portions 183 so as to penetrate the upper end plate 160T. In the fan-shaped region R surrounded by the first half line L1, which passes through the center O2 of the upper discharge hole 190T with the center O1 of the shaft hole 162 as a starting point, the second half line 12, which passes through the center O3 of the upper rivet hole 191T with the center O1 of the shaft hole 162 as a starting point, and the outer peripheral surface 182*a* of the outer peripheral portion 182 in the axial view, the through hole 184A is formed so as to be continuous in the circumferential direction of the fan-shaped region R, and both ends 184*c* of the through hole 184A in the circumferential direction of the fan-shaped region R, are located outside the fan-shaped region R. As a result, since the connection portion 183 is not disposed in the fan-shaped region R described above, it is possible to suppress the deformation of the recess portion 193 caused by the stress according to the joining between the main body container 10 and the upper end plate 160T being transmitted through the connection portion 183. Therefore, it is possible to prevent distortion from occurring on the sliding surface 185 of the center portion 181 due to the stress transmitted from the main body container 10 to the center portion 181 at the time of joining the main body container 10 and the upper end plate 160T.

In the compressor 1 of the embodiment, the welding portion V, which joins the main body container 10 and the outer peripheral portion 182 of the upper end plate 160T, is provided on the outer peripheral side of the through hole 184A, which is disposed in the fan-shaped region R. As described above, even in the structure in which the stress is easily transmitted from the welding portion V to the recess portion 193 at the time of welding the upper end plate 160T and the main body container 10, since the connection portion 183 is not disposed in the fan-shaped region R, the stress is suppressed from being transmitted from the welding portion V to the recess portion 193 through the connection portion 183, and the occurrence of the distortion of the sliding surface 185 can be suppressed.

In the upper end plate 160T of the compressor 1 of the embodiment, the connection portion 183 is formed adjacent to the fan-shaped region R in the axial view. As a result, the upper end plate 160T can appropriately secure the mechanical strength in the portion of the fan-shaped region R where the through hole 184A is continuously formed.

The center portion 181 of the upper end plate 160T in the compressor 1 of the embodiment has the upper end face 181*a*, in which the recess portion 193 is formed, and the lower end face 181*b*, in which the sliding surface 185 is formed. Therefore, when deformation occurs in the recess portion 193, the sliding surface 185 is likely to be distorted, but the formation of the through hole 184A in the fan-shaped region R prevents distortion from occurring in the sliding surface 185, and an increase in resistance during sliding between the upper piston 125T and the sliding surface 185 is prevented.

In the center portion 181 of the upper end plate 160T in the compressor 1 of the embodiment, the thickness h1 between the sliding surface 185 and the upper end face 181*a*, and the thickness h2 of the bottom plate 196 between the sliding surface 185 and the bottom surface 195*b* in the recess portion 193 satisfy $(h2/h1) \leq 0.25$. In this case, since the difference between the thickness of the center portion 181 and the thickness of the bottom plate 196 of the recess portion 193, is large and the rigidity of the recess portion 193, is low, the recess portion 193 in the center portion 181 is likely to be locally deformed. However, in the embodiment, the occurrence of deformation of the recess portion 193 and distortion of the sliding surface 185 can be effectively suppressed by the through hole 184A in the fan-shaped region R.

In the upper end plate 160T of the compressor 1 of the embodiment, the outer diameter d1 of the outer peripheral portion 182, and the outer diameter d2 of the center portion 181 satisfy $(d2/d1) \geq 0.65$. In this case, the outer peripheral portion 182, which is joined to the main body container 10, and the center portion 181 come close to each other, and the stress is easily transmitted from the main body container 10 to the recess portion 193 of the center portion 181, so that the recess portion 193 is easily deformed. However, in the embodiment, the occurrence of deformation of the recess portion 193 and distortion of the sliding surface 185 can be effectively suppressed by the through hole 184A in the fan-shaped region R.

In the upper end plate 160T of the compressor 1 of the embodiment, the outer diameter d1 of the outer peripheral portion 182, and the width w1 of the outer peripheral portion 182 in the radial direction of the shaft hole 162 satisfy $(w1/d1 \leq 0.05$. In this case, since the width w of the outer peripheral portion 182 with respect to the outer diameter d1 of the outer peripheral portion 182, is small, and the rigidity of the outer peripheral portion 182, is low, the stress transmitted from the main body container 10 to the center portion 181, tends to increase. However, in the embodiment, the occurrence of deformation of the recess portion 193 and distortion of the sliding surface 185 can be effectively suppressed by the through hole 184A in the fan-shaped region R.

In the upper end plate 160T of the compressor 1 of the embodiment, the outer diameter d1 of the outer peripheral portion 182 is 100 [mm] or less. In this case, the main body container 10, which has a small outer diameter, and the center portion 181 come close to each other, and the stress is easily transmitted from the main body container 10 to the recess portion 193, so that the recess portion 193 is easily deformed. However, in the embodiment, the occurrence of deformation of the recess portion 193 and distortion of the sliding surface 185 can be effectively suppressed by the through hole 184A in the fan-shaped region R.

In the inner wall surfaces 194*a* and 195*a* of the recess portion 193 of the upper end plate 160T in the embodiment, a portion continuous with the connection portion 183 in the radial direction of the shaft hole 162, is formed into a curved surface. As a result, the stress transmitted from the connection portion 183 to the recess portion 193, is easily dispersed along the curved surfaces of the inner wall surfaces 194*a* and 195*a*, and the rigidity of the portion where the stress is easily transmitted, is increased. Therefore, in the present embodiment, the stress, from the connection portion 183, is transmitted to the portions formed by the curved surfaces of the inner wall surfaces 194*a* and 195*a*, so that the occurrence of the deformation of the recess portion 193 and the distortion of the sliding surface 185 can be suppressed.

The compressor disclosed in the present application, is applied to the two-cylinder compressor, but may be applied to a one-cylinder compressor. The compressor disclosed in the present application, is not limited to the rotary compressor, and may be applied to, for example, a scroll compressor, an air compressor, and the like.

REFERENCE SIGNS LIST

1 COMPRESSOR
10 MAIN BODY CONTAINER
10*a* INNER PERIPHERAL SURFACE
11 MOTOR
12 COMPRESSION SECTION
15 ROTATION SHAFT
121T UPPER CYLINDER (CYLINDER)
121S LOWER CYLINDER (CYLINDER)
125T UPPER PISTON (PISTON)
125S LOWER PISTON (PISTON)
160T UPPER END PLATE (END PLATE)
161T MAIN BEARING PORTION
162 SHAFT HOLE
181 CENTER PORTION
181*a* UPPER END FACE (FIRST END FACE)
181*b* LOWER END FACE (SECOND END FACE)
182 OUTER PERIPHERAL PORTION
182*a* OUTER PERIPHERAL SURFACE
183 CONNECTION PORTION
184 (184A) THROUGH HOLE
184*c* BOTH ENDS
185 SLIDING SURFACE
190T UPPER DISCHARGE HOLE (DISCHARGE HOLE)
191T UPPER RIVET HOLE (FIXING HOLE)
193 RECESS PORTION
194 FIRST RECESS PORTION
194*a* INNER WALL SURFACE
195 SECOND RECESS PORTION
195*a* INNER WALL SURFACE
195*b* BOTTOM SURFACE
196 BOTTOM PLATE
200T UPPER DISCHARGE VALVE (REED VALVE)
202T UPPER RIVET (FIXING MEMBER)
L1 FIRST HALF LINE
L2 SECOND HALF LINE
O1 CENTER
O2 CENTER
R FAN-SHAPED REGION
V WELDING PORTION
h1, h2 THICKNESS
d1, d2 OUTER DIAMETER
w WIDTH

The invention claimed is:

1. A compressor comprising:

a compression section that compresses a working fluid;

a motor that drives the compression section;

a rotation shaft that transmits a driving force of the motor to the compression section; and a main body container that accommodates the compression section and the motor, wherein the compression section has a cylinder that forms a compression chamber of the working fluid, a piston that is disposed in the compression chamber, and an end plate that closes one end of the cylinder in an axial direction of the rotation shaft, the end plate has a shaft hole through which the rotation shaft passes, a center portion in which the shaft hole is provided and that forms a sliding surface on which the piston slides, an annular outer peripheral portion that is disposed on the outer peripheral side of the center portion and has an outer peripheral surface that is joined to an inner peripheral surface of the main body container, a plurality of connection portions that connect the center portion and the outer peripheral portion, and a plurality of through holes that are formed between the adjacent connection portions to penetrate the end plate, the center portion is provided with a recess portion having a discharge hole for discharging the working fluid from the compression section, and a fixing hole through which a fixing member for fixing a reed valve for opening and closing the discharge hole to the end plate passes, and in a fan-shaped region surrounded by a first half line starting from the center of the shaft hole and passing through the center of the discharge hole, a second half line starting from the center of the shaft hole and passing through the center of the fixing hole, and the outer peripheral surface of the outer peripheral portion, when the compressor is viewed in the axial direction of the rotation shaft, the through hole is formed to be continuous in the circumferential direction of the fan-shaped region, and both ends of the through hole in a circumferential direction of the fan-shaped region are located outside the fan-shaped region.

2. The compressor according to claim 1, wherein the main body container is provided with a welding portion that joins the main body container and the outer peripheral portion, and the welding portion is provided on the outer peripheral side of the through hole, which is disposed in the fan-shaped region.

3. The compressor according to claim 1, wherein the connection portion is formed adjacent to the fan-shaped region, when the compressor is viewed in the axial direction of the rotation shaft.

4. The compressor according to claim 1, wherein the center portion of the end plate has a first end face on which the recess portion is formed, and a second end face on which the sliding surface is formed.

5. The compressor according to claim 4, wherein when a thickness between the sliding surface and the first end face is h1, and a thickness between the sliding surface and a bottom surface in the recess portion is h2, the center portion of the end plate satisfies $$(h2/h1) \leq 0.25.$$

6. The compressor according to claim 1, wherein when an outer diameter of the outer peripheral portion is d1 and an outer diameter of the center portion is d2, the end plate satisfies $$(d2/d1) \geq 0.65.$$

7. The compressor according to claim 1, wherein when an outer diameter of the outer peripheral portion is d1 and a width of the outer peripheral portion in a radial direction of the shaft hole is w1, the end plate satisfies $$(w1/d1) \leq 0.05.$$

8. The compressor according to claim 1, wherein an outer diameter of the outer peripheral portion of the end plate is 100 [mm] or less.

9. The compressor according to claim 1, wherein the recess portion has an inner wall surface along an axial direction of the rotation shaft, and a portion of the inner wall surface continuous with the connection portion in the radial direction of the shaft hole is formed into a curved surface.

* * * * *